US006578713B1

(12) United States Patent
Matsuura et al.

(10) Patent No.: US 6,578,713 B1
(45) Date of Patent: Jun. 17, 2003

(54) PAPER SHEET PROCESSOR AND METHOD OF PROCESSING PAPER SHEET

(75) Inventors: Shinji Matsuura, Nagareyama (JP); Hajime Morino, Toda (JP)

(73) Assignee: Glory Kogyo Kabushiki Kaisha (JP)

( * ) Notice: Subject to any disclaimer, the term of this patent is extended or adjusted under 35 U.S.C. 154(b) by 0 days.

(21) Appl. No.: 09/688,952

(22) Filed: Oct. 16, 2000

(51) Int. Cl.[7] ..... B07C 5/00
(52) U.S. Cl. ..... 209/534; 209/567; 209/900
(58) Field of Search ..... 209/534, 567, 209/569, 900; 271/8.1, 10.01, 265.01

(56) References Cited

U.S. PATENT DOCUMENTS 4,830,742 A * 5/1989 Takesako ..... 209/534
5,135,212 A * 8/1992 Utsumi et al. ..... 271/9 X
5,173,590 A * 12/1992 Nakano et al. ..... 209/534 X
5,402,895 A * 4/1995 Mikkelsen et al. ..... 209/534

FOREIGN PATENT DOCUMENTS

JP 59-53358 * 3/1984 ..... 209/534

* cited by examiner

*Primary Examiner*—Tuan N. Nguyen
(74) *Attorney, Agent, or Firm*—Renner, Kenner, Greive, Bobak, Taylor & Weber

(57) ABSTRACT

A paper sheet processor includes a paper sheet setting portion for setting a plurality of paper sheets approximately uniformed in face-and-back orientation, a feeding section for sequentially introducing the paper sheets set on the paper sheet setting portion one after another, a discriminator for discriminating at least face-and-back orientation of each paper sheet introduced, a first stacker as a main stacker, a second stacker as a sub-stacker having a smaller capacity than that of the first stacker, and a controller for controlling such that the paper sheet first fed and discriminated in face-and-back orientation by the discriminator and any paper sheets subsequently fed and discriminated to have the same face-and-back orientation as that of the first fed paper sheet are stacked in the first stacker, and the other paper sheets discriminated to be different in face-and-back orientation from the first fed paper sheet are stacked in the second stacker. Even when a bundle of paper sheets to be re-checked, which are approximately uniform in face-and-back orientation, are set in the paper sheet processor in erroneous-face-and-back orientation, the processor can rationally carry out face-and-back re-orientation by stacking the front-faced or back-faced majority part of the paper sheets in the main stacker having a larger capacity and stacking the back-faced or front-faced minority of the paper sheets in the sub-stacker having a smaller capacity.

9 Claims, 9 Drawing Sheets

PAPER SHEET PROCESSOR AND METHOD OF PROCESSING PAPER SHEET

BACKGROUND OF THE INVENTION

1. Field of the Invention

This invention relates to a paper sheet processor, and more particularly to a banknote processor having a plurality of stackers and capable of efficiently re-checking banknotes.

2. Description of the Background Art

U. S. Patent Publication No. 4,830,742 discloses a prior art concerning a banknote processor having a plurality of stackers and the function of discriminating face-and-back orientations of banknotes.

This prior-art banknote processor has three stackers, namely two sorting stackers and one rejection stacker. Based on judgment about face-and-back orientation by a discriminator, the processors stacks front-faced banknotes on the upper sorting stacker, and back-faced banknotes on the lower sorting stacker, so as to uniform the face-and-back orientation of banknotes.

Since the processor shown in the publication uses two sorting stackers equal in volume, it can efficiently uniform the face-and-back orientation of bank notes when it deals with a random mixture of front-faced banknotes and back-faced banknotes. However, when it is used for re-checking banknotes previously uniformed in face-and-back orientation to a certain extent, much more banknotes are stacked in one of the sorting stackers, and it is not rational from the viewpoint of stacking space.

For the purpose of use the processor shown in the publication in re-checking banknotes, it could be modified by omitting one of the sorting stackers so as to stack back-faced banknotes in the rejection stacker.

In this case, however, if an operator using the banknote processor erroneously puts approximately uniformly faced banknotes on a setting portion, facing majority's back faces upward, then the back-faced majority banknotes set on the machine are stacked in the rejection stacker with a smaller containing space, and the rejection stacker soon become full.

This kind of problem generally occurs not only with banknotes but also with any kinds of paper sheets such as securities.

SUMMARY OF THE INVENTION

It is therefore an object of the invention to provide a paper sheet processor capable of uniforming face-and-back orientation of paper sheets regardless of the way of setting the paper sheets, and suitable for re-checking paper sheets approximately uniformed in face-and-back orientation previously.

According to the invention, there is provided a paper sheet processor comprising: a paper sheet setting portion for setting a plurality of paper sheets approximately uniformed in face-and-back orientation; a feeding section to sequentially feed the paper sheets set on said paper sheet setting portion one after another; a discriminator for discriminating at least face-and-back orientation of each paper sheet introduced; a first stacker as a main stacker; a second stacker as a sub-stacker having a smaller capacity than that of the first stacker; and a controller for controlling such that the paper sheet first introduced and discriminated in face-and-back orientation by the discriminator is stacked on the first stacker, and regarding second and subsequent paper sheets, those having the same face-and-back orientation as that of the first introduced paper sheet are stacked on the first stacker and the others having the opposite face-and-back orientation from that of the first introduced paper sheet are stacked on the second stacker.

Also when the second paper sheet, et seq. do not coincide with the first paper sheet in orientation of a pattern, denomination of banknotes or genuineness, the discriminator can stack paper sheets in a second stacker.

According to the invention, even when an operator erroneously puts approximately uniformly faced paper sheets on a setting portion, facing majority's back faces upward, the processor sorts the majority front-faced or back-faced paper sheets to the main stacker having a larger capacity and the minority back-faced or front-faced paper sheets to the sub-stacker having a smaller capacity, thereby to rationally uniform the face-and-back orientation.

DETAILED DESCRIPTION OF THE PREFERRED EMBODIMENTS

Some embodiments of the invention will be explained below with reference to the drawings.

Figure 1:
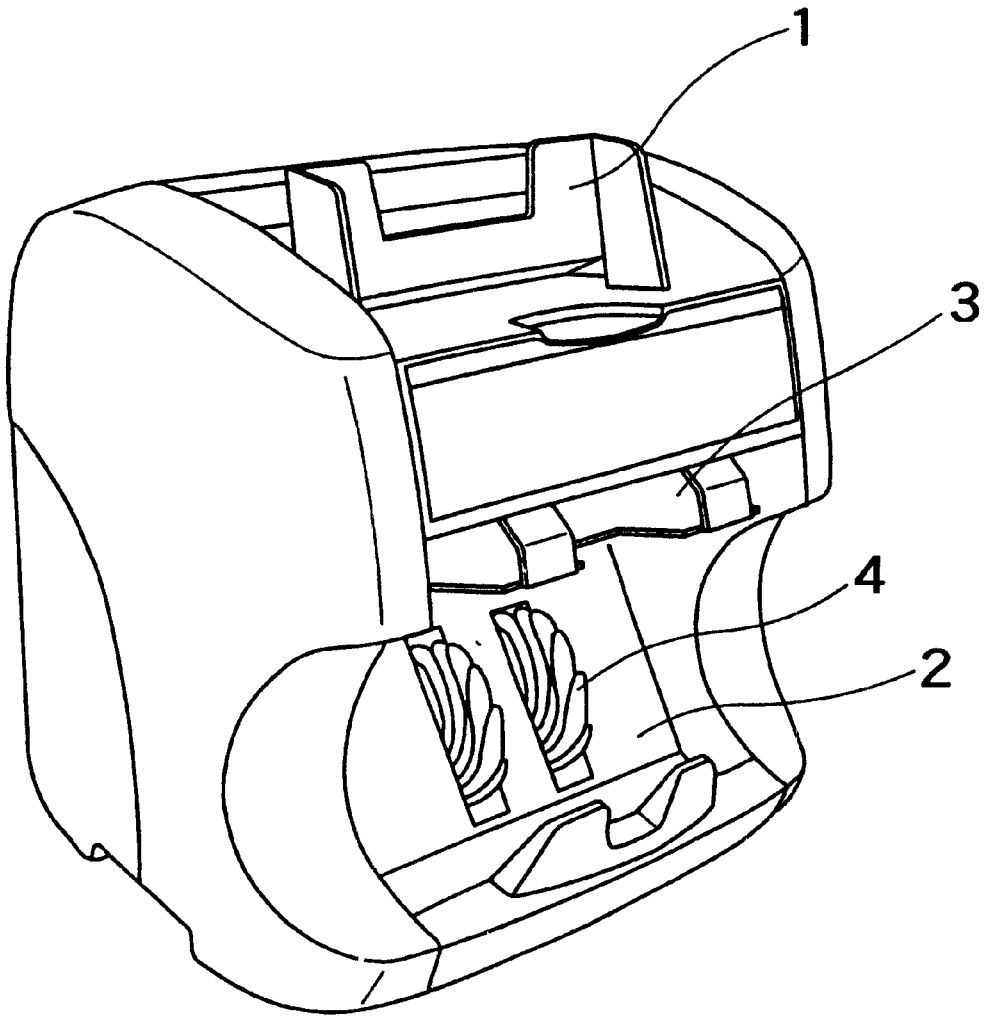
FIG. 1 is a perspective view of an external appearance of a banknote processor taken as an embodiment of the paper sheet processor according to the invention.

FIG. 1 is a perspective view that shows an external appearance of a banknote processor taken as a typical embodiment of the paper sheet processor according to the invention. A setting portion (hopper) 1 for supporting a bundle of banknotes to be counted and processed is defined on the top surface, a first stacker (main stacker) 2 is located at the bottom, and a second stacker (sub-stacker) 3 is located at an intermediate position. The main stacker 2 is equipped with a vane wheel 4 for stacking banknotes in alignment. For example, the hopper 1 has the capacity of 300 banknotes, the main stacker 2 has the capacity of 200 banknotes, and the sub-stacker has the capacity of 20 banknotes.

Figure 2:
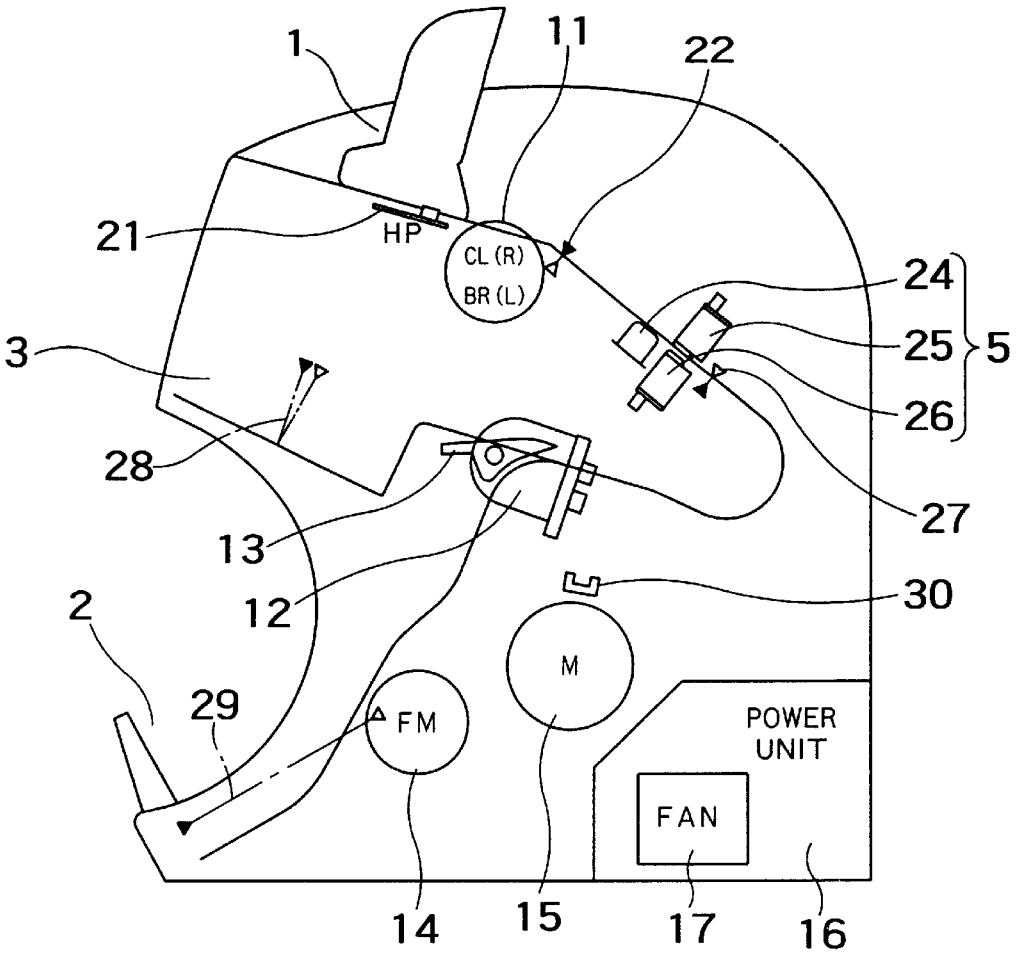
FIG. 2 is a sectional view of the banknote processor shown in FIG. 1.

FIG. 2 is a sectional view of the banknote processor shown in FIG. 1, and mainly illustrates a banknote passageway and various sensors. First regarding the passageway, it is divided into a path for banknotes fed from the hopper 1 by a feed roller 11 having a brake and a clutch then traveling through a discriminator, explained later, and directed toward the second stacker at branching point where a guide claw 13 by a solenoid 12, and a path toward the first stacker 2 for guiding normal banknotes.

Next explained is a sensor system. This processor includes a hopper sensor (HP) 21 for detecting that banknotes are set on the hopper 1, a first sensor (SPI) 22 for detecting that each banknote is normally fed immediately downstream the feed roller 11, a magnetic sensor (MG) 24 for detecting magnetic ink on each banknote, reflection-type optical sensors (REF) 25, 26 for detecting patterns, or the like, on each banknote, a double check sensor (SP2) 27, a stacker sensor (ST) 29 for detecting whether the first stacker 2 contains any banknote or not, a reject (RJ) sensor 28 for detecting whether the second stacker 3 contains any rejected banknote or not, and an encoder 30 for detecting rotation of a motor. The sensors SP1, SP2, REF and MG are provided in each of the right left sides. Among these sensors, the magnetic sensor 24 and the optical sensors (REF) 25 and 26 form the discriminator designated by the numeral 5 in FIG. 2, and this discriminator 5 functions to discriminate face-and-back orientations, orientation of a pattern, denomination of banknotes, genuineness of banknotes.

This banknote processor further includes a power source unit 16 having a fan 17 therein to supply an electric power to motors and light sources of sensors using light.

Figure 3:
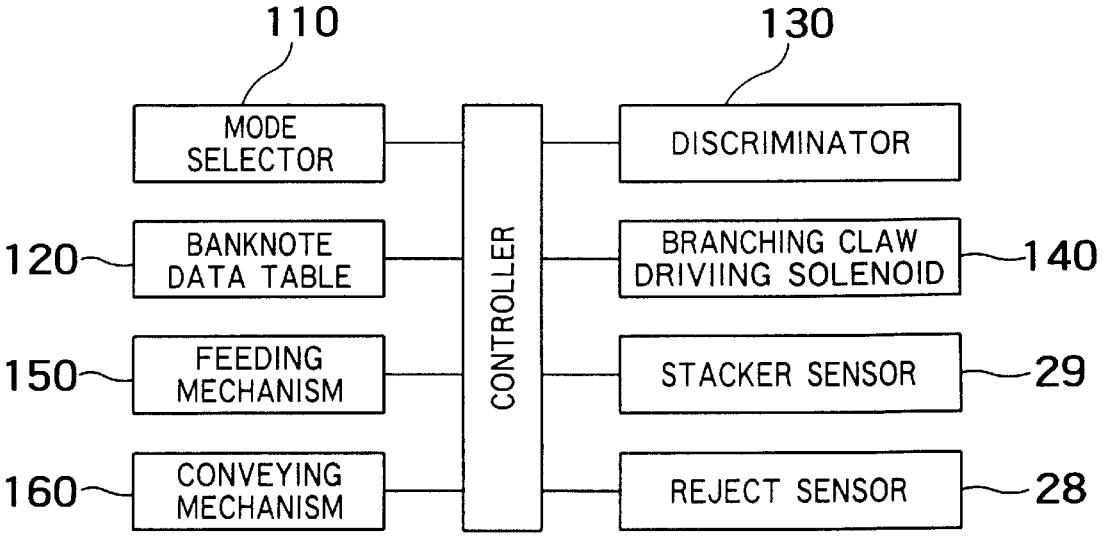
FIG. 3 is a block diagram of the banknote processor shown in FIGS. 1 and 2.

FIG. 3 is a block diagram that shows general configuration of the banknote processor according to the invention. A controller controls a mode selector 110 for selecting a process mode, a banknote data table 120 that stores data on denomination of banknotes, a discriminator 130 (designated by the numeral 5 in FIG. 2) for discriminating supplied banknotes, a branching claw driving solenoid 140 that drives the guide claw for switching destination of each banknote between the first stacker and the second stacker with reference to a result of discrimination, feeding mechanism 150, and a conveying mechanism 160, respectively. Outputs of the stacker sensor 29 and the reject sensor 28 are input to the controller. Let the banknote data table store reference data about front surfaces and back surfaces of different denomination of banknotes.

Figure 4:
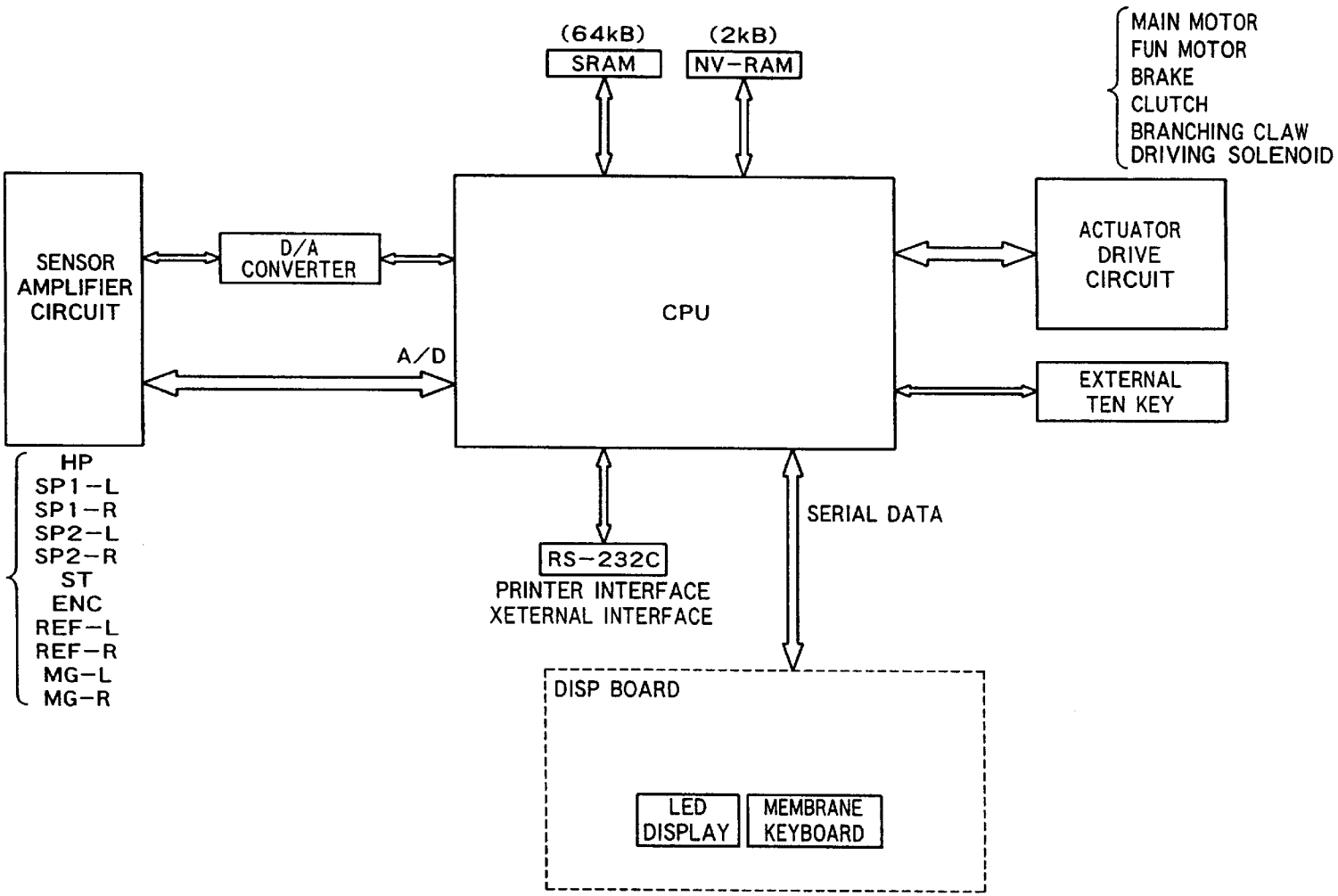
FIG. 4 is a block diagram of a more specific configuration of that shown in FIG. 3.

FIG. 4 is a block diagram that shows how the configuration of FIG. 3 is realized as hardware.

The discriminator 130 of FIG. 3 exchanges data with CPU through a sensor AMP circuit and a D/A converter corresponding to the controller, and the branching claw driving solenoid 140 exchanges data with CPU via an actuator drive circuit. The mode selector 110 is realized as a display portion that includes an LED display and membrane keys. The banknote data table 120 is provided in internal ROM of CPU. Furthermore, numerical keys are also provided.

Next explained are processing modes that can be selected through the mode selector.

In the broadest classification, the banknote processor has the following three processing modes.

(1) MIX Mode

This is a mode for processing a bundle of banknotes including various kinds of denomination. Once this mode is selected, all banknotes specified to be certain denomination of banknotes by the discriminator 5 are guided to the first stacker, and the others that cannot be discriminated or are determined not to be genuine are guided to the second stacker. The banknotes specified in denomination are summed in amount every time of processing. The invention is applicable to this mode.

(2) DD Mode

This is a mode for detecting different kinds of denomination. Once this mode is selected, the discriminator 5 identifies denomination of the first introduced banknote and this banknote is guided to the first stacker. Subsequent banknotes of the same denomination are also guided to the first stacker, and those of different denomination, those impossible to specify and counterfeit notes are guided to the second stacker.

It is recommended to re-check banknotes by using the invention to this mode because banknotes to be re-checked are normally uniformed in face-and-back orientation to a certain extent, and the second stacker as the sub-stacker will seldom become full.

(3) COUNT Mode

Once this mode is selected, the functions of the discriminator 5 to discriminate face-and-back orientation, pattern, denomination and genuineness do not work at all, and the processor exclusively counts the number of paper sheets. This mode is used to count the number of paper sheets other than banknotes, or to count banknotes of foreign countries, for example, data of which are not input in the storage table of the banknote processor.

Since this mode does not use the discriminating function, there is no room for application of the present invention.

Next explained are behaviors of the banknote processor according to the invention.

Figure 5:
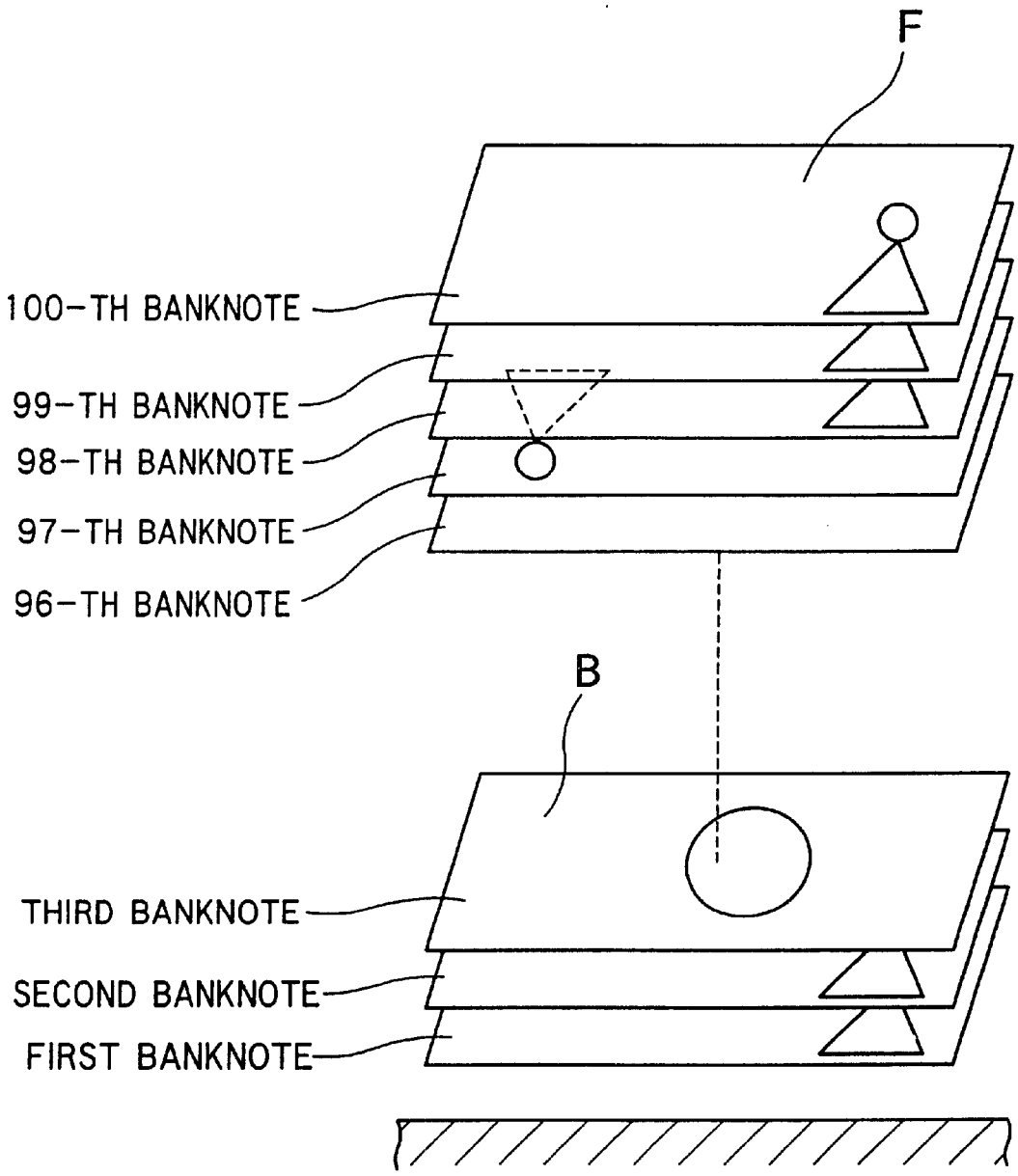
FIG. 5 is a typical example of a bundle of banknotes to be re-checked, which are approximately uniformed in face-and-back orientation previously.

FIG. 5 is a typical example of a bundle of banknotes to be re-checked, which are approximately uniformed in face-and-back orientation previously. In. this example, the bundle of banknotes does not include different kinds of denomination or counterfeit notes. In FIG. 5, F denotes front faces of banknotes to be re-checked, and B denotes their back faces. In this example, most of the banknotes are oriented with their front faces upward and with a uniform orientation of the pattern, but they are not completely uniformed in face-and-back orientation. Specifically, the third banknote is oriented with its back face upward, and the 97th banknote is oriented with its pattern upside down, although it is oriented with its front face upward.

FIGS. 6 through 9 are flowcharts that illustrate an example of behaviors of the banknote processor according to the invention.

Figure 6:
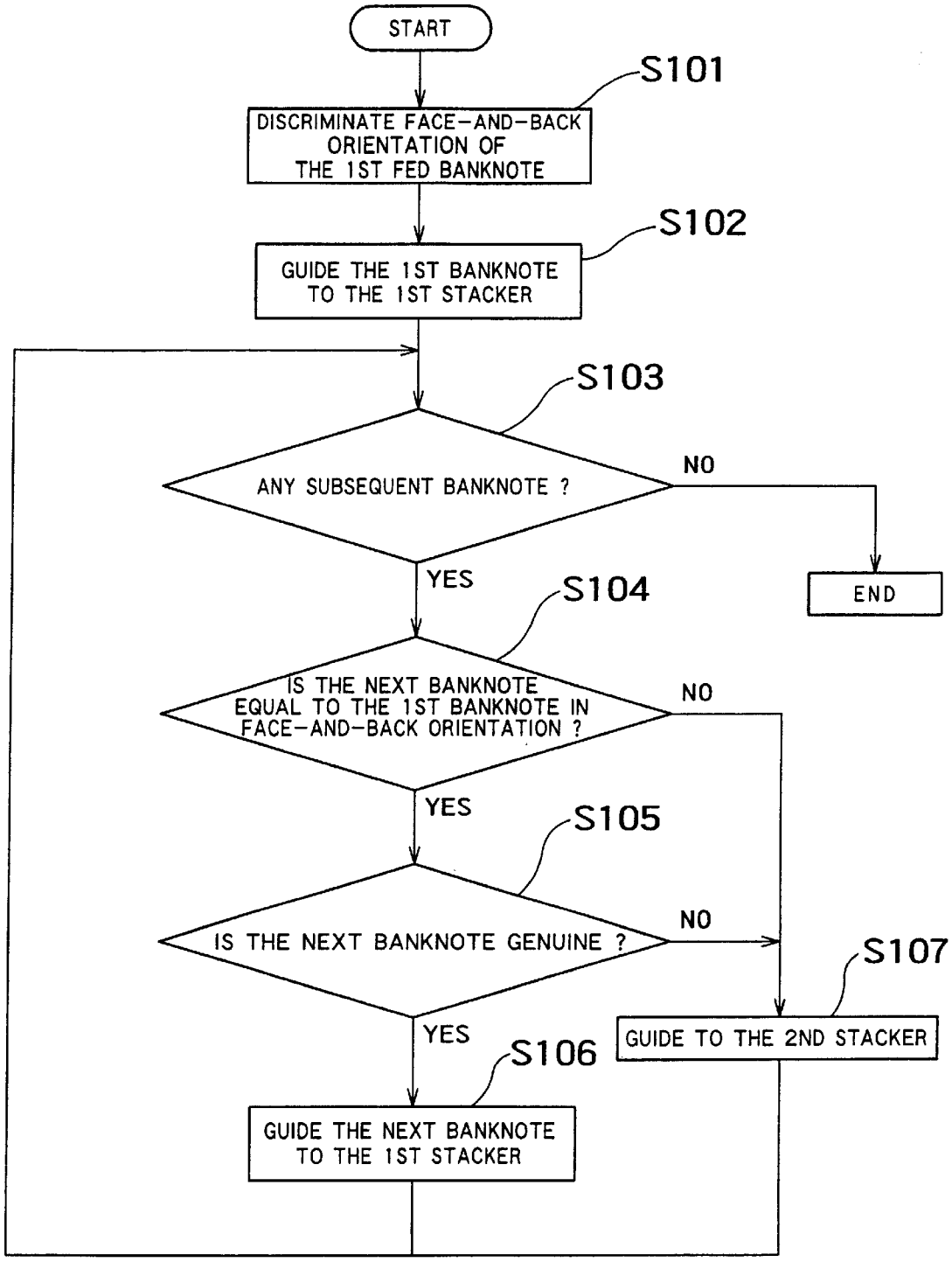
FIG. 6 is a flowchart of the process of re-checking face-and-back orientation by a banknote processor according to an embodiment of the invention.

FIG. 6 is a flowchart that shows a process of re-checking banknotes under the status of FIG. 5. This process is the DD mode.

A plurality of banknotes (normally of a bundle of 100 sheets) set on the hopper 1 shown in FIG. 1 are sequentially fed one after another from the bottom one by a feeding mechanism labeled with 11 in FIG. 2, and discriminated about their face-and-back orientation by the discriminator 5 shown in FIG. 2 (step S101). The first fed banknote (i.e. the lower-most banknote), after being discriminated about its face-and-back orientation, is guided to the first stacker 2 (main stacker) shown in FIG. 1 (step S102). The face-and-back orientation of the first banknote is stored in a storage means.

Next judged is whether any subsequent banknote exists or not (step S103). If not, the process terminates there. If any subsequent banknote exists, it is fed, and discriminated about its face-and-back orientation by the discriminator 5. If it is determined to have the same face-and-back orientation as the first fed banknote (step S104), it undergoes confirmation about genuineness (step S105) and it is guided to the first stacker 2 shown in FIG. 1 (step S106). On the other hand, if the subsequent banknote is different in face-and-back orientation from the first banknote, or it is not a genuine banknote, the guide claw 13 shown in FIG. 2 is changed to guide it to the second stacker 3 of FIG. 1 (step S107).

After that, steps from S103 to S107 are repeated as far as the next banknote exists.

In this embodiment, it is not determined previously whichever stacker is used to stack the banknote having the face-and-back orientation used as the basis of discrimination of face-and-back orientation. Instead, it is configured to direct the first fed banknote (the banknote located at the bottom among banknotes put on the setting portion (hopper) 1 to be re-checked) and other banknotes having the same face-and-back orientation as the first one to the main stacker, and direct other banknotes different in face-and-back orientation from the first one to the sub-stacker. In this way, regardless of how the banknotes to be re-checked are put on the setting portion, the processor can always direct the majority part or all (when manual alignment of their face-and-back orientation is complete) of the banknotes to the main stacker.

In the embodiment shown here, capacity of the setting portion 1 (hopper) is 300 sheets, capacity of the first stacker 2 (main stacker) is 200 sheets, and capacity of the second stacker 3 (sub-stacker) is 20 sheets, as proposed above. If a bundle of banknotes to be re-checked contains 100 sheets, and those erroneously oriented manually are within 20 sheets, overflow of banknotes from one of stackers does not occur even if the bundle is set to orient the majority part of banknotes reversely.

In this way, by making a difference in capacity between the first stacker and the second stacker (proportion of 10:1 in this embodiment), it is possible to effectively use the physical space within the limited vertical dimension of the processor and to make it compact accordingly.

Figure 7:
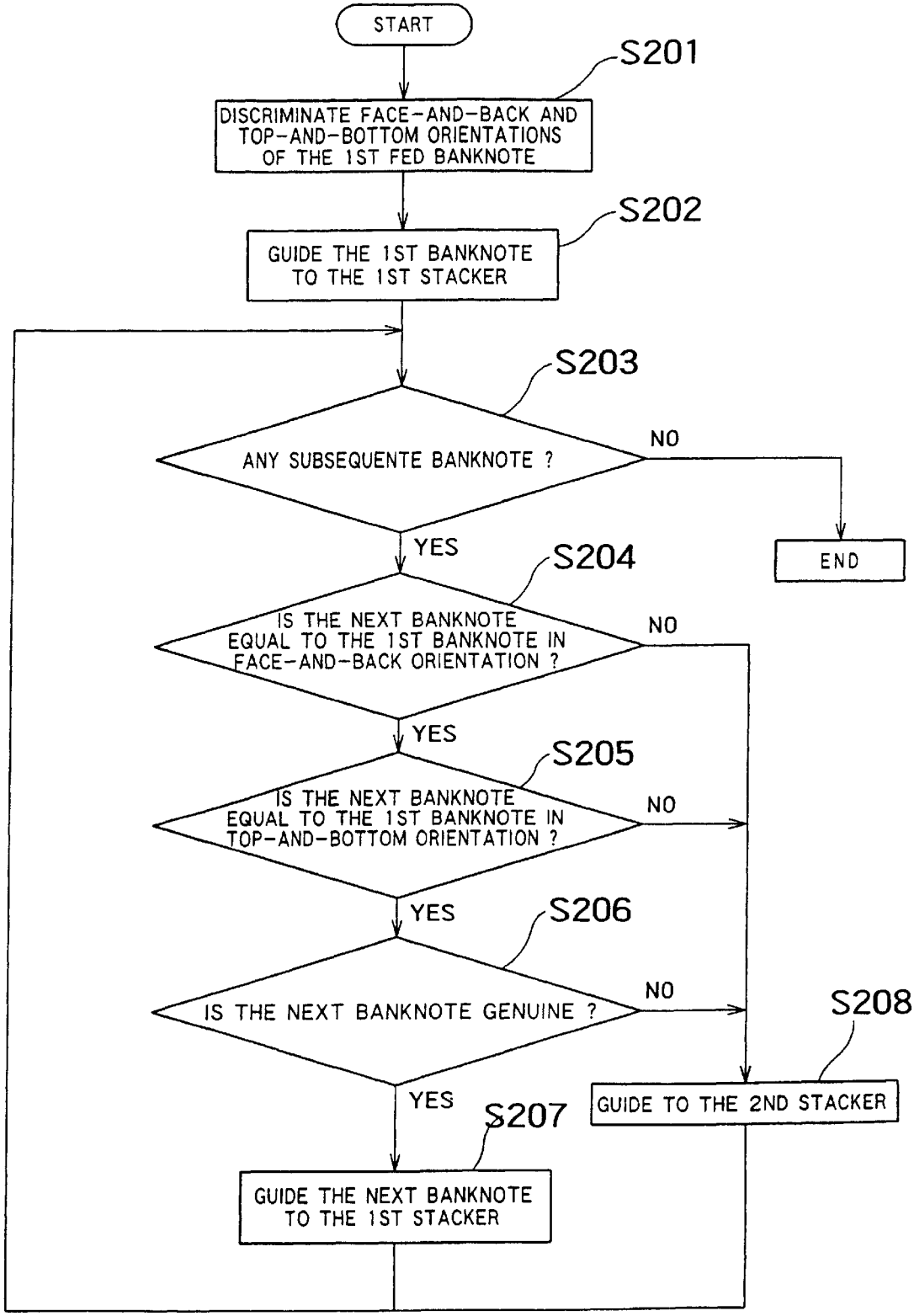
FIG. 7 is a flowchart of the process of re-checking face-and-back orientation by a banknote processor according to another embodiment of the invention.

In the processor shown in FIG. 6, explanation has been made merely about face-and-back orientation of banknotes. However, similar control is possible when the pattern orientation is involved as an additional subject of the control. Since banknotes to be re-checked are normally bundled in the unit of 100 sheets, and roughly aligned in face-and-back orientation and pattern orientation manually beforehand. However, as shown in FIG. 5, it is possible that such a bundle contains some banknotes different in face-and-back orientation or pattern orientation. Therefore, the processor is useful when such a bundle is required to be in complete alignment. FIG. 7 shows a process usable for this purpose.

Banknotes put on the setting portion (hopper) 1 of FIG. 1 are sequentially fed one after another, and their face-and-back orientations are discriminated by the discriminator 5 shown in FIG. 2 (step S201). The first fed banknote (i.e. the lower-most banknote), after being discriminated about its face-and-back orientation and pattern orientation, is guided to the first stacker 2 (main stacker) (step S202). The face-and-back orientation and top-and-bottom orientation of the first banknote are stored in a storage means.

Next judged is whether any subsequent banknote exists or not (step S203). If not, the process terminates there. If any subsequent banknote exists, it is fed, and discriminated about its face-and-back orientation (step S204) and top-and-bottom orientation by the discriminator 5 (step S205). If it is determined to have the same face-and-back orientation and top-and-bottom orientation as the first fed banknote, it undergoes confirmation about genuineness (step S206) and it is guided to the first stacker 2 shown in FIG. 1 (step S207). On the other hand, if the subsequent banknote is different in face-and-back orientation and top-and-bottom orientation from the first banknote, or it is not a genuine banknote, the guide claw 13 shown in FIG. 2 is changed to guide it to the second stacker 3 of FIG. 1 (step S208).

After that, steps from S203 to S208 are repeated as far as the next banknote exists.

Figure 8:
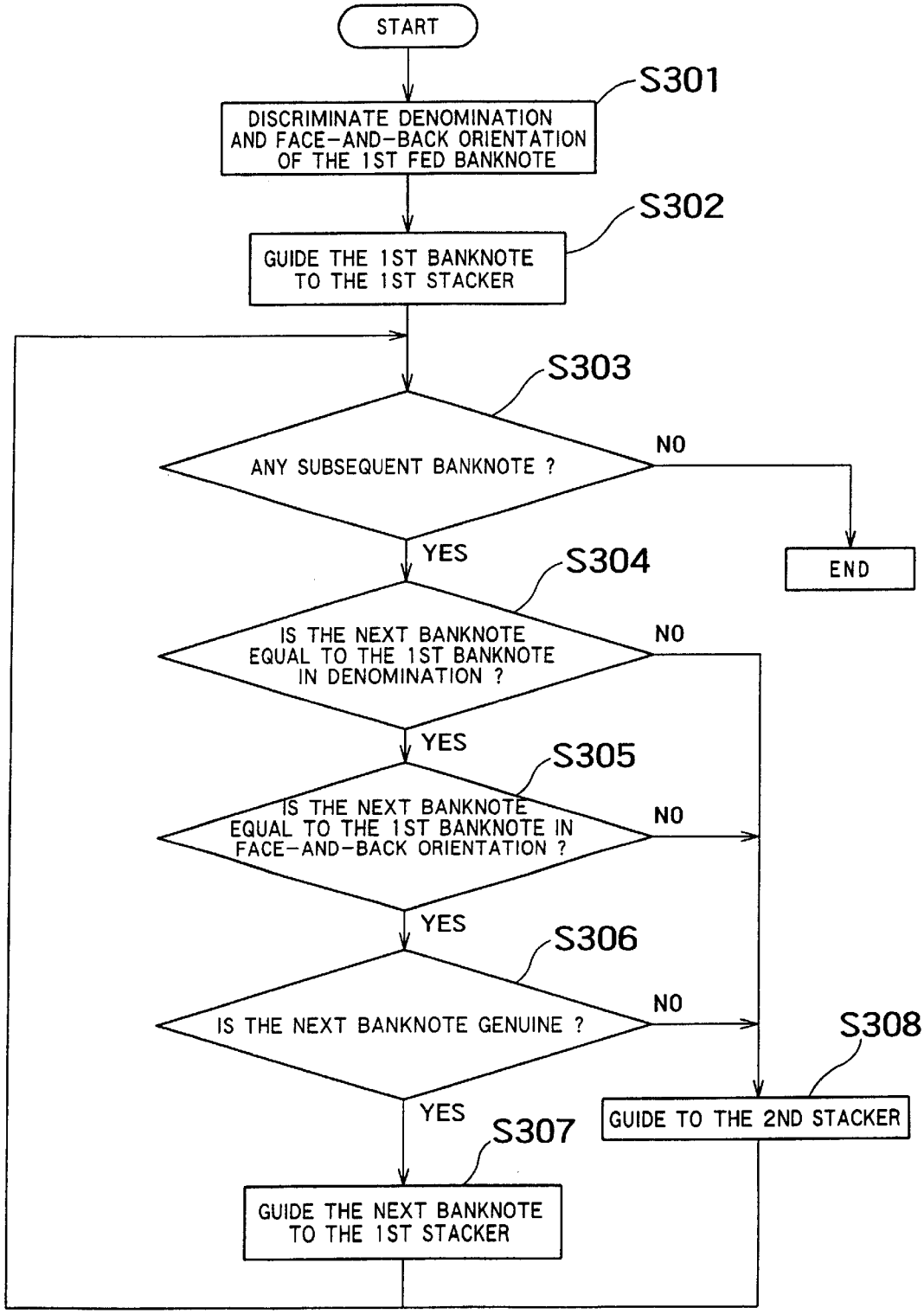
FIG. 8 is a flowchart of the process of re-checking denomination of bank notes and their face-and-back orientation by a banknote processor according to a further embodiment of the invention.

FIG. 8 shows a process of re-checking, taking kinds of denomination into consideration in addition to face-and-back orientation, based on the same concept. This process is effective when a bundle of banknotes to be re-checked contains banknotes of a different kind of denomination or counterfeit notes, and also applicable in case of the MIX mode.

Banknotes put on the setting portion (hopper) 1 of FIG. 1 are sequentially fed one after another, and their denomination and face-and-back orientation are discriminated by the discriminator 5 shown in FIG. 2 (step S301). The first fed banknote (i.e. the lower-most banknote), after being discriminated about its denomination and face-and-back orientation, is guided to the first stacker 2 (main stacker) (step S302). The denomination and face-and-back orientation of the first banknote are stored in a storage means.

Next judged is whether any subsequent banknote exists or not (step S303). If not, the process terminates there. If any subsequent banknote exists, it is fed, and discriminated about its denomination by the discriminator 5 (step S304). If it is determined to be of the same denomination as the first fed banknote, it undergoes confirmation about coincidence of face-and-back orientation (step S305) and genuineness (step S306) and it is guided to the first stacker 2 shown in FIG. 1 (step S307). On the other hand, if the subsequent banknote is different in denomination and face-and-back orientation from the first banknote, or it is not a genuine banknote, the guide claw 13 shown in FIG. 2 is changed to guide it to the second stacker 3 of FIG. 1 (step S308).

After that, steps from S303 to S308 are repeated as far as the next banknote exists.

Figure 9:
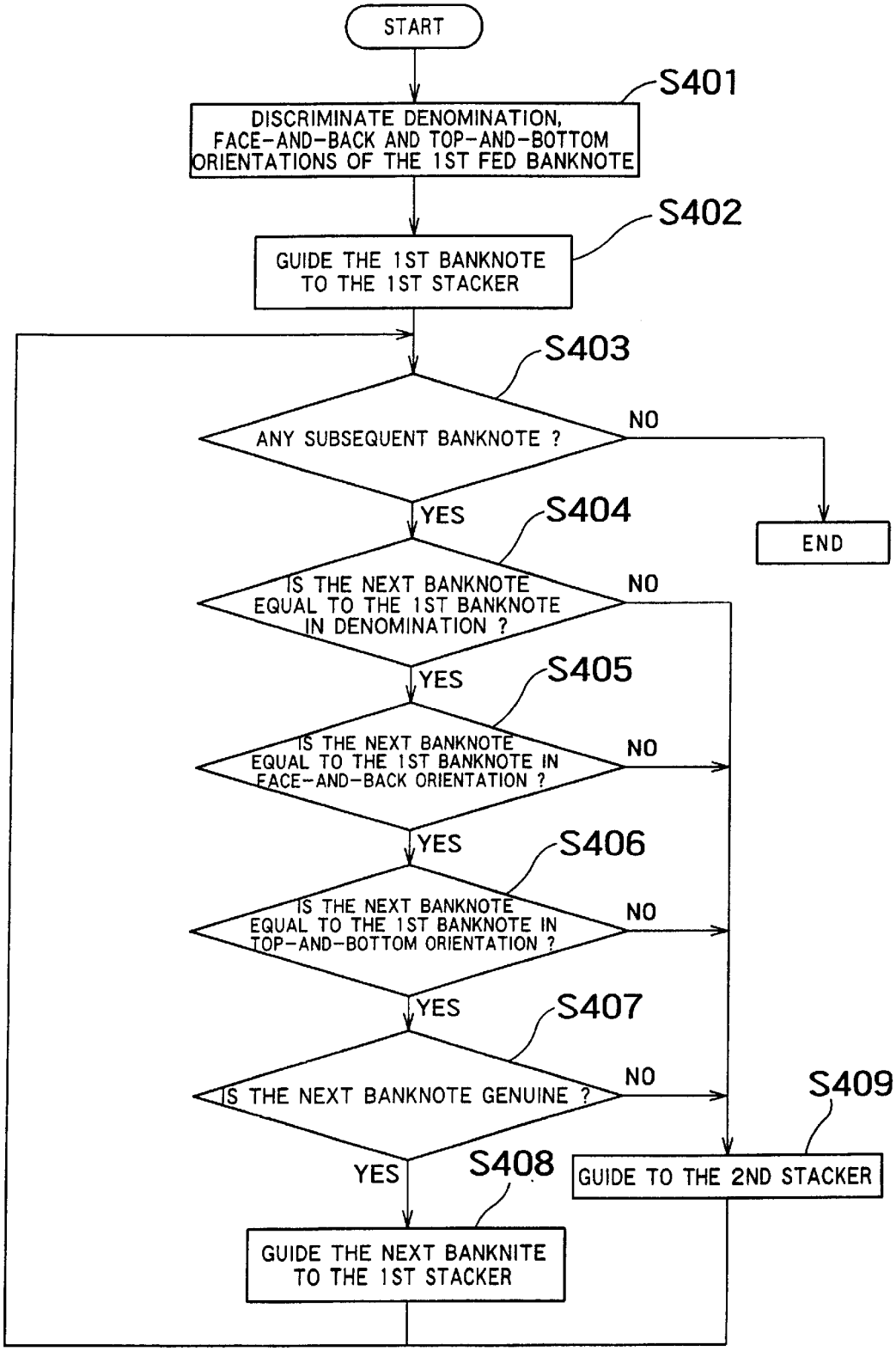
FIG. 9 is a flowchart of the process of re-checking denomination of bank notes and their face-and-back orientation by a banknote processor according to a still further embodiment of the invention.

FIG. 9 shows a process of re-checking face-and-back orientation and top-and-bottom orientation in addition to the denomination.

Banknotes put on the setting portion (hopper) 1 of FIG. 1 are sequentially fed one after another, and their denomination, face-and-back orientation and top-and-bottom orientation are discriminated by the discriminator 5 shown in FIG. 2 (step S401). The first fed banknote (i.e. the lower-most banknote), after being discriminated about those items, is guided to the first stacker 2 (main stacker) (step S402). The denomination, face-and-back orientation and top-and-bottom orientation of the first banknote are stored in a storage means.

Next judged is whether any subsequent banknote exists or not (step S403). If not, the process terminates there. If any subsequent banknote exists, it is fed, and discriminated about its denomination (step S404), face-and-back orientation (step S405) and top-and-bottom orientation (S406) by the discriminator 5. If it is determined to coincide with the first fed banknote in those respects, it undergoes confirmation about genuineness (step S407) and it is guided to the first stacker 2 shown in FIG. 1 (step S408). On the other hand, if the subsequent banknote is different in denomination (step S404), face-and-back orientation (step S405) and top-and-bottom orientation (step S406) from the first banknote, or it is not a genuine banknote (step S407), the guide claw 13 shown in FIG. 2 is changed to guide it to the second stacker 3 of FIG. 1 (step S409).

After that, steps from S403 to S408 are repeated as far as the next banknote exists.

Next explained is a process of judging face-and-back orientation.

In the banknote process according to this embodiment, dollar bank notes are mainly handled. Regarding dollar banknotes, there is such a special condition that different kinds of denomination have only a small difference among their front-face patterns but they are respectively characterized in back-face patterns. Taking it into consideration, the instant embodiment discriminates denomination by detecting back-face patterns with a reflection sensor and using front-face patterns as a supplemental means of discrimination.

Figure 10:
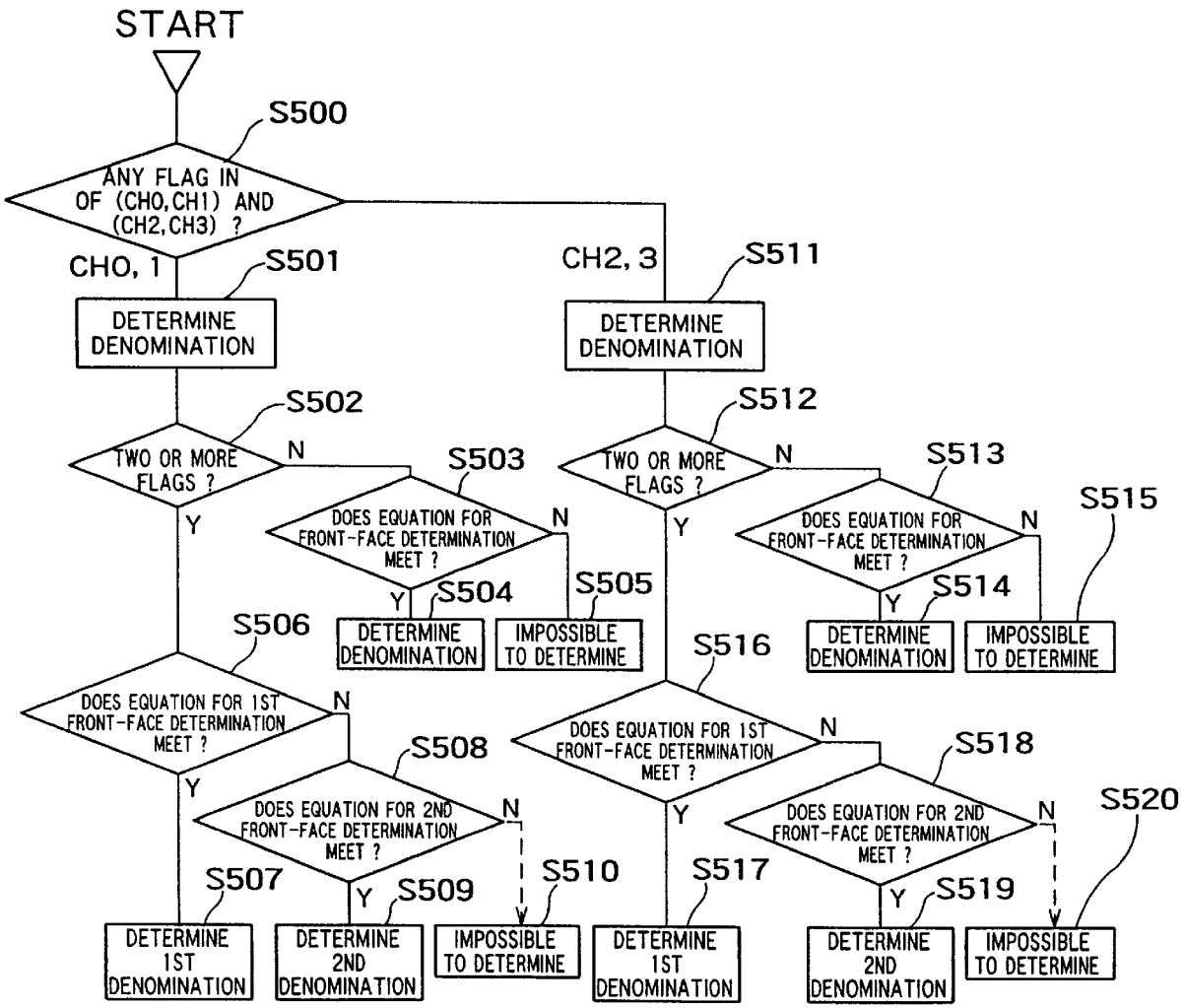
FIG. 10 is a flowchart that shows steps of discriminating denomination of banknotes and discriminating face-and-back orientation.

FIG. 10 is a flowchart that shows a process of discriminating denomination and face-and-back orientation. Assume here that the face-and-back orientation discrimination shown here is carried out, based on outputs from reflection-type optical sensors 25 and 26 that placed in confrontation in different levels along the passage from the hopper 1 to the guide claw 13, as already explained with reference to FIG. 1. Let the optical sensor 26 have channel CH0 and CH1, and the optical sensor 25 have channels CH2 and CH3, respectively.

When a banknote to be judged in denomination passes through, the following operation takes place in each channel. Namely, data obtained by analog to digital conversion of an output of each channel of the optical sensors 25, 26 is stored into SRAM in response to each pulse by a pulse which is an encoder output with reference to shading by the bank note. Then, an equation for discriminating denomination from the back face about the data stored in SRAM is computed, and a flag is on for a possible candidate denomination. In this case, since the back-face discrimination equation is used, the flag is not on with the optical sensor for the front face, and it is judged there is no corresponding banknote. The flowchart shown here starts from this point.

First judged is whichever set of (CH0, CH1) and (CH2, CH3) a flag stands in (step S500). If a flag stand in the set of (CH0, CH1), it means that banknotes have been set in the hopper 1 with their back face down, i.e. with their front face upward. When a flag stands in the set of (CH2, CH3), it means that banknotes have been set in the hopper 1 with their front face down, i.e. with their back face upward.

First explained is the case where banknotes are set to orient their front face upward, that is, denomination flags are set in CH0 and CH1.

By passing a logical product of the denomination flag of each channel through an AND gate, a candidate denomination can be obtained (step S501). Denomination obtained here is not always a single kind of denomination, but some kinds of denomination may be obtained. Therefore, it is reviewed whether a plurality of denomination flags are standing (step S502). If there is only a single kind of denomination, the denomination is confirmed (step S503). This confirmation is to confirm uses outputs of CH2 and CH3 about the denomination and thereby judges whether it fits the discrimination equation about the front-face pattern. When it meets the discrimination equation, the denomination is definitely determined (step S504). When it does not meet the discrimination formula, determination of denomination is impossible (step S505).

On the other hand, when some kinds of denomination are obtained, these kinds of denomination are confirmed by means of their surface patterns. This confirmation is carried out by conducting calculation using a first discrimination equation about the first kind of denomination (step S506), and if it meets this discrimination equation, it is definitely determined as the first kind of denomination (step S507). If confirmation with the first discrimination equation is impossible, calculation is conducted by using a second discrimination equation for the second kind of denomination (step S508). If it meets this equation, it is definitely determined as the second kind of denomination (step S509). If three or more kinds of denomination candidates are obtained, additional judgment is conducted, using front-face patterns of further kinds of denomination. If no other candidate is found, it is concluded that determination is impossible (step S510).

Through those steps, the banknote is finally determined in denomination and face-and-back orientation.

Similarly, when banknotes are set to orient their front-faces downward, since the back faces make upper surfaces, denomination flags are set in CH2 and CH3 (step S511), and similarly to the foregoing explanation, depending upon a plurality of denomination flags or a single flag (step S512), confirmation is carried out by using front-face patterns with signals obtained at CH0 and CH1, and the banknote is finally determined in denomination and face-and-back orientation (steps S513 to S520). The process is absolutely identical to steps S501 to S510.

As a specific example, here is explained is the case where 100-dollar banknotes are set in the hopper 1 to orient their front faces upward.

When one of the banknote passes through the passage way, operation of a discrimination equation based on a back-face pattern is carried out by signals obtained by the upper-located reflection sensor 25 and the lower-located reflection sensor 26. In this case, however, a denomination flag stands with the output of the lower-located reflection sensor 26. Assume here that flags of 1 dollar, 2 dollars and 100 dollars are raised in CH0, and flags of one dollar and 100 dollars are raised in CH1. As a result, since two flags of 1 dollar and 100 dollars are obtained in step S503, confirmation using the discrimination equation for a one-dollar banknote in step S504 cannot confirm it to be a one-dollar banknote, and it is finally confirmed by the next discrimination equation for a 100-dollar banknote that it is a genuine 100-dollar banknote and its upper surface is the front face.

As explained above, face-and-back orientation can be specified, depending upon whichever of two reflection sensors 25, 26 provides denomination candidates.

Although the embodiments explained above are configured to guide an introduced banknote to the second stacker 2 (sub-stacker) of FIG. 2 regardless of its denomination, face-and-back orientation and top-and-bottom orientation when it is judged by the discriminator 5 not to be a genuine banknote, it is also possible to omit the judgment about genuineness.

The foregoing explanation has been made about a banknote processor. However, the invention is also applicable to any paper sheet processor for re-checking any kinds of paper sheets, such as securities (checks and others), merchandise coupons, and so on, other than banknotes.

What is claimed is:

1. A paper sheet processor comprising:

a paper sheet setting portion to set a plurality of paper sheets approximately uniformed in face-and-back orientation;

a feeding section to sequentially feed the paper sheets set on said paper sheet setting portion one after another;

a discriminator to discriminate at least face-and-back orientation of each paper sheet introduced;

a first stacker as a main stacker;

a second stacker as a sub-stacker having a smaller capacity than that of said first stacker; and a controller to control such that the paper sheet first introduced and discriminated in face-and-back orientation by said discriminator is stacked on said first stacker regardless of discrimination result, and regarding second and subsequent paper sheets, paper sheets having the same face-and-back orientation as that of said first introduced paper sheet are stacked on said first stacker and paper sheets having the opposite face-and-back orientation from that of the first introduced paper sheet are stacked on said second stacker, if the latter paper sheets have been mixed in the plurality of paper sheets approximately uniformed in face-back-orientation.

2. The paper sheet processor according to claim 1 wherein said discriminator additionally has the function of discriminating genuineness, and when an introduced paper sheet is discriminated not to be genuine, said controller makes said paper sheet stacked on said second stacker.

3. The paper sheet processor according to claim 1 wherein said discriminator additionally has the function of discriminating orientation of a pattern on paper sheets, and if a second or later introduced paper sheet is discriminated to have the same face-and-back orientation and the same pattern orientation, said controller makes the second or later introduced paper sheet stacked on said first stacker, whereas, if a second or later introduced paper sheet is different from said first introduced paper sheet in at least one of face-and-back orientation and pattern orientation, said controller makes the paper sheet stacked on said second stacker.

4. The paper sheet processor according to claim 3 wherein said discriminator additionally has the function of discriminating genuineness, and when an introduced paper sheet is discriminated not to be genuine, said controller makes said paper sheet stacked on said second stacker.

5. The paper sheet processor according to claim 1 wherein said discriminator additionally has the function of discriminating denomination of paper sheets, and if a second or later introduced paper sheet is discriminated to be of the same denomination and face-or-back as those of said first introduced paper sheet, said controller makes the second or later introduced paper sheet stacked on said first stacker, whereas, if a second or later introduced paper sheet is of different denomination and face-or-back from those of said first introduced paper sheet, said controller makes the second or later introduced paper sheet stacked on said second stacker.

6. The paper sheet processor according to claim 5 wherein said discriminator additionally has the function of discriminating genuineness, and when an introduced paper sheet is discriminated not to be genuine, said controller makes said paper sheet stacked on said second stacker.

7. The paper sheet processor according to claim 5 wherein said discriminator additionally has the function of discriminating pattern orientation of paper sheets, and if a second or later introduced paper sheet is discriminated to be of the same denomination as, and has the same face-and-back orientation and the same pattern orientation as, those of said first introduced paper sheet, said controller makes the second or later introduced paper sheet stacked on said first stacker, whereas, if a second or later introduced paper sheet is discriminated to be different from said first introduced paper sheet in at least one of denomination, face-and-back orientation and pattern orientation, said controller makes the second or later introduced paper sheet stacked on said second stacker.

8. The paper sheet processor according to claim 7 wherein said discriminator additionally has the function of discriminating genuineness, and when an introduced paper sheet is discriminated not to be genuine, said controller makes said paper sheet stacked on said second stacker.

9. A method of processing paper sheet, comprising the steps of:

sequentially feeding a plurality of paper sheets approximately uniformed in face-and-back orientation one after another;

discriminating at least face-and-back orientation of each introduced paper sheet; and controlling a paper sheet first introduced and discriminated in face-and-back orientation to be stacked on a first stacker as a main stacker regardless of discrimination result, and for paper sheets other than the first introduced paper sheet, controlling those equal to the first introduced paper sheet in face-and back orientation to be stacked on said first stacked and paper sheets different from the first introduced paper sheet in face-and-back orientation to be stacked on a second stacker as a sub-stacker having a smaller capacity than that of said first stacker, if the latter paper sheets have been mixed in the plurality of paper sheets approximately uniformed in face-back-orientation.

* * * * *